US012510293B2

(12) United States Patent
Park et al.

(10) Patent No.: US 12,510,293 B2
(45) Date of Patent: Dec. 30, 2025

(54) OPERATION CONTROL METHOD FOR REFRIGERATOR

(71) Applicant: LG ELECTRONICS INC., Seoul (KR)

(72) Inventors: Kyong Bae Park, Seoul (KR); Sung Jhee, Seoul (KR); Yun Su Cho, Seoul (KR); Young Seung Song, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 134 days.

(21) Appl. No.: 18/289,323

(22) PCT Filed: May 23, 2022

(86) PCT No.: PCT/KR2022/007309
§ 371 (c)(1),
(2) Date: Nov. 2, 2023

(87) PCT Pub. No.: WO2022/270771
PCT Pub. Date: Dec. 29, 2022

(65) Prior Publication Data

US 2024/0240852 A1 Jul. 18, 2024

(30) Foreign Application Priority Data

Jun. 24, 2021 (KR) ..... 10-2021-0082389

(51) Int. Cl.
*F25D 29/00* (2006.01)
*F25D 17/06* (2006.01)

(52) U.S. Cl.
CPC ..... *F25D 29/00* (2013.01); *F25D 17/062* (2013.01); *F25D 2317/068* (2013.01); *F25D 2400/02* (2013.01); *F25D 2500/04* (2013.01)

(58) Field of Classification Search
CPC .... F25D 29/00; F25D 17/062; F25D 2400/02; F25D 2317/068; F25D 17/06; F25B 2700/173
See application file for complete search history.

(56) References Cited

U.S. PATENT DOCUMENTS

2018/0156225 A1* 6/2018 Izumi ..... H02K 7/14

* cited by examiner

*Primary Examiner* — Lionel Nouketcha
(74) *Attorney, Agent, or Firm* — Bryan Cave Leighton Paisner LLP

(57) ABSTRACT

The present disclosure provides a refrigerator operation control method capable of accurately recognizing whether an abnormal situation occurs as well as determining a defrosting time using an identified rotation speed of a blowing fan.

22 Claims, 9 Drawing Sheets

[FIG. 1]
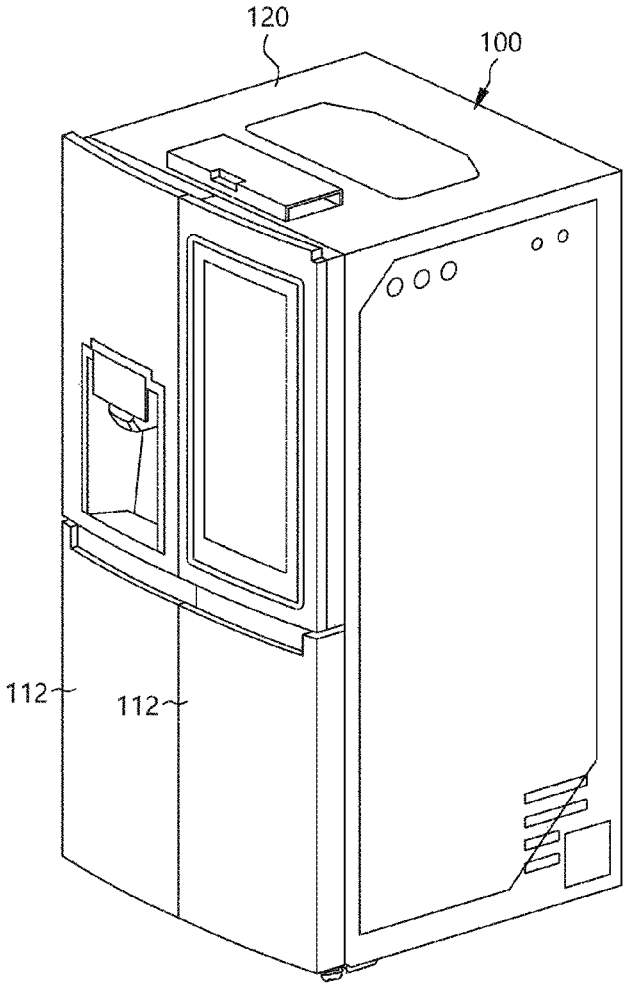

[FIG. 2]
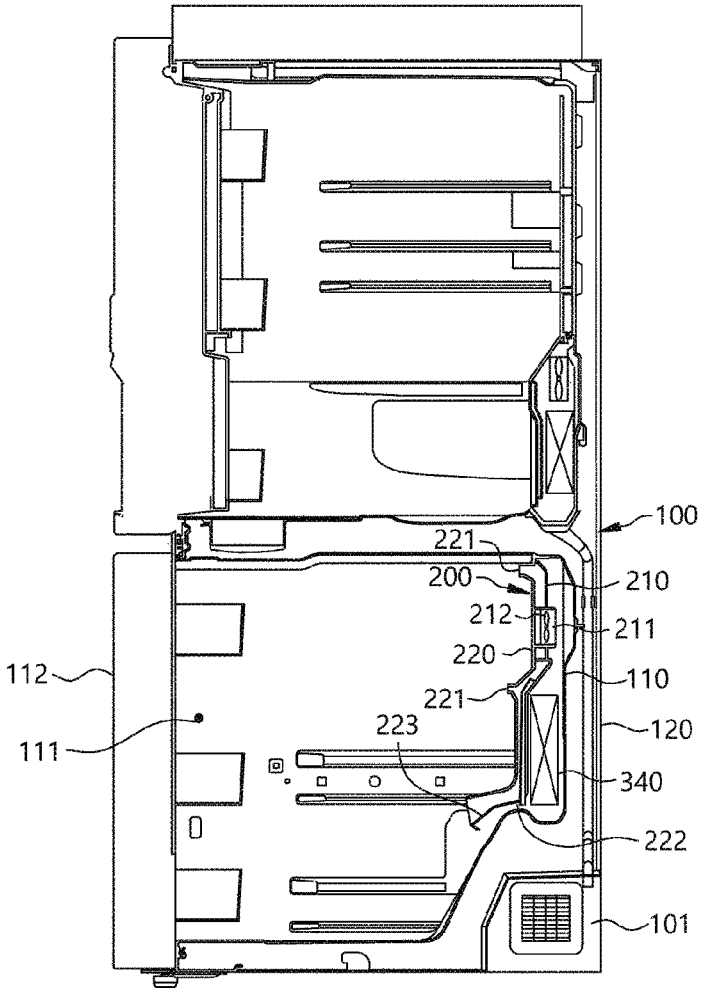

[FIG. 3]
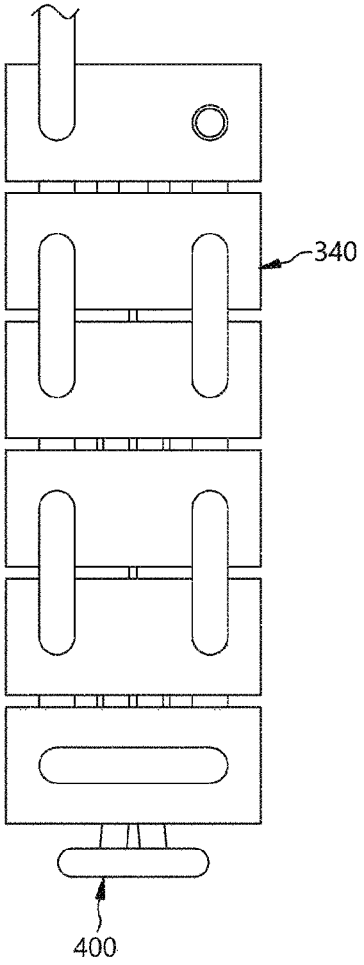
[FIG. 4]
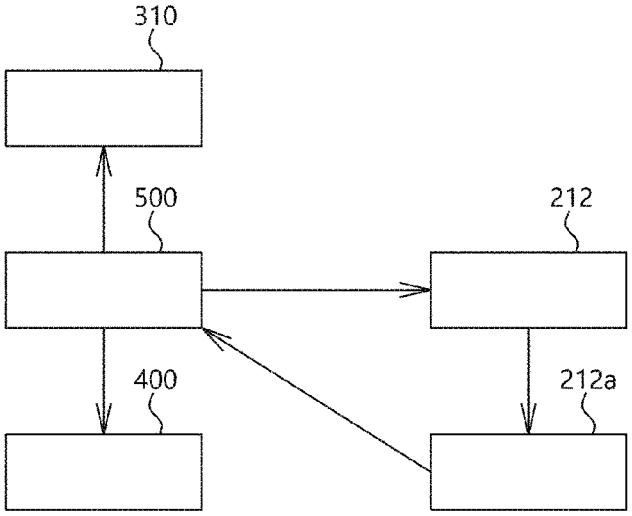

[FIG. 5]
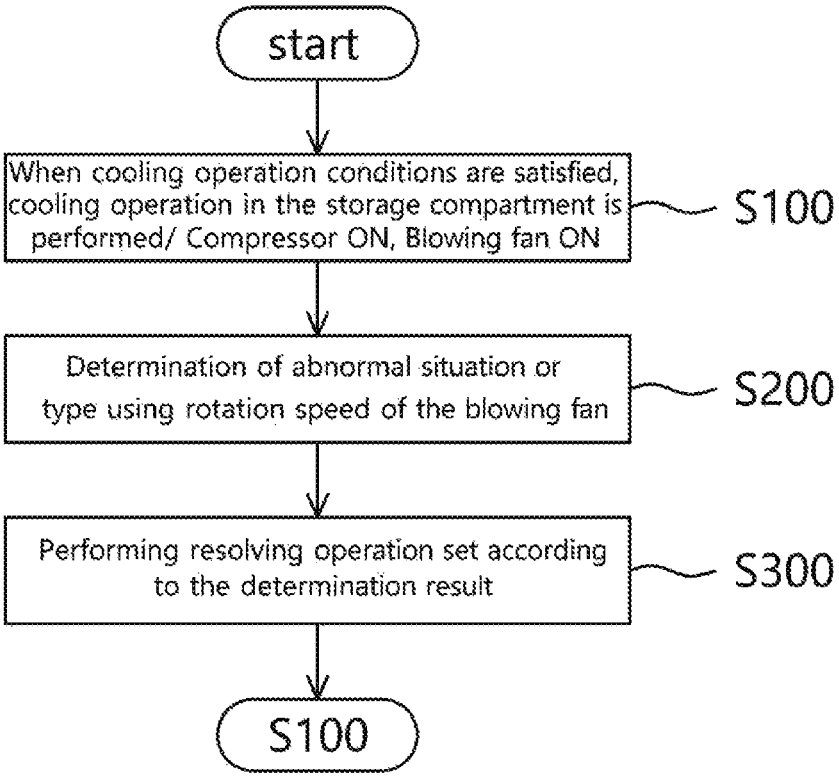

[FIG. 6]
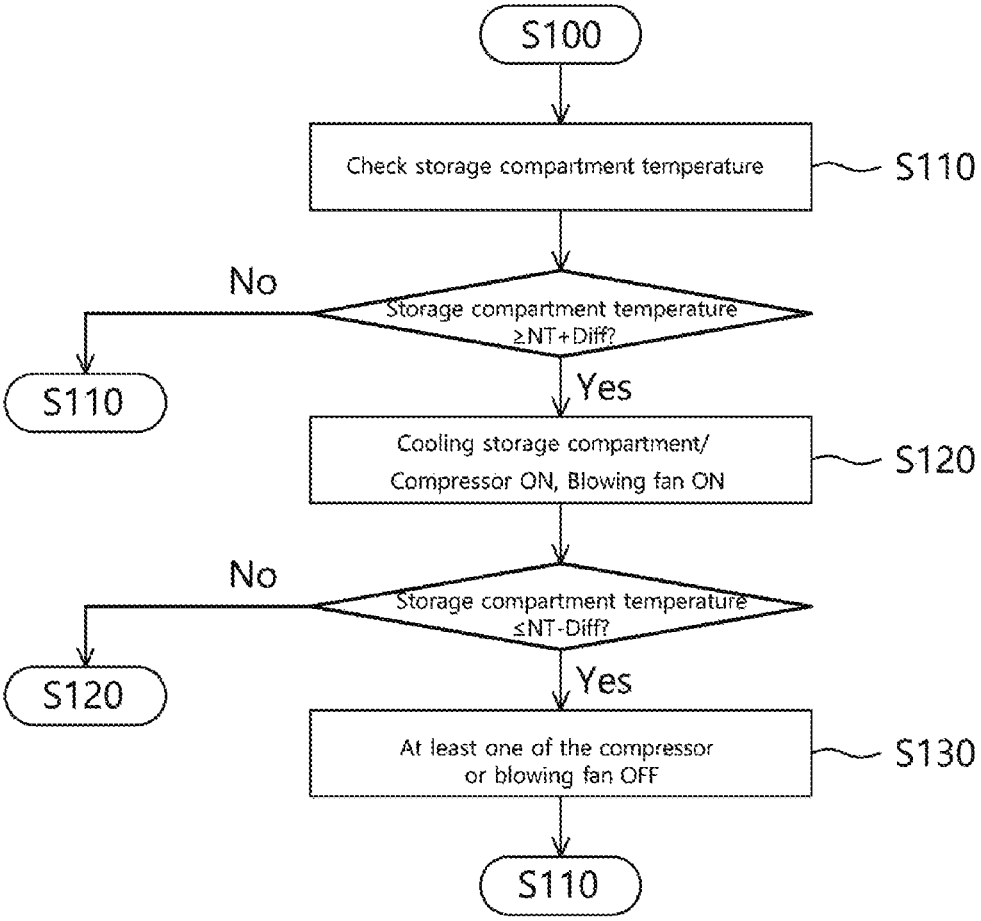

[FIG. 7]
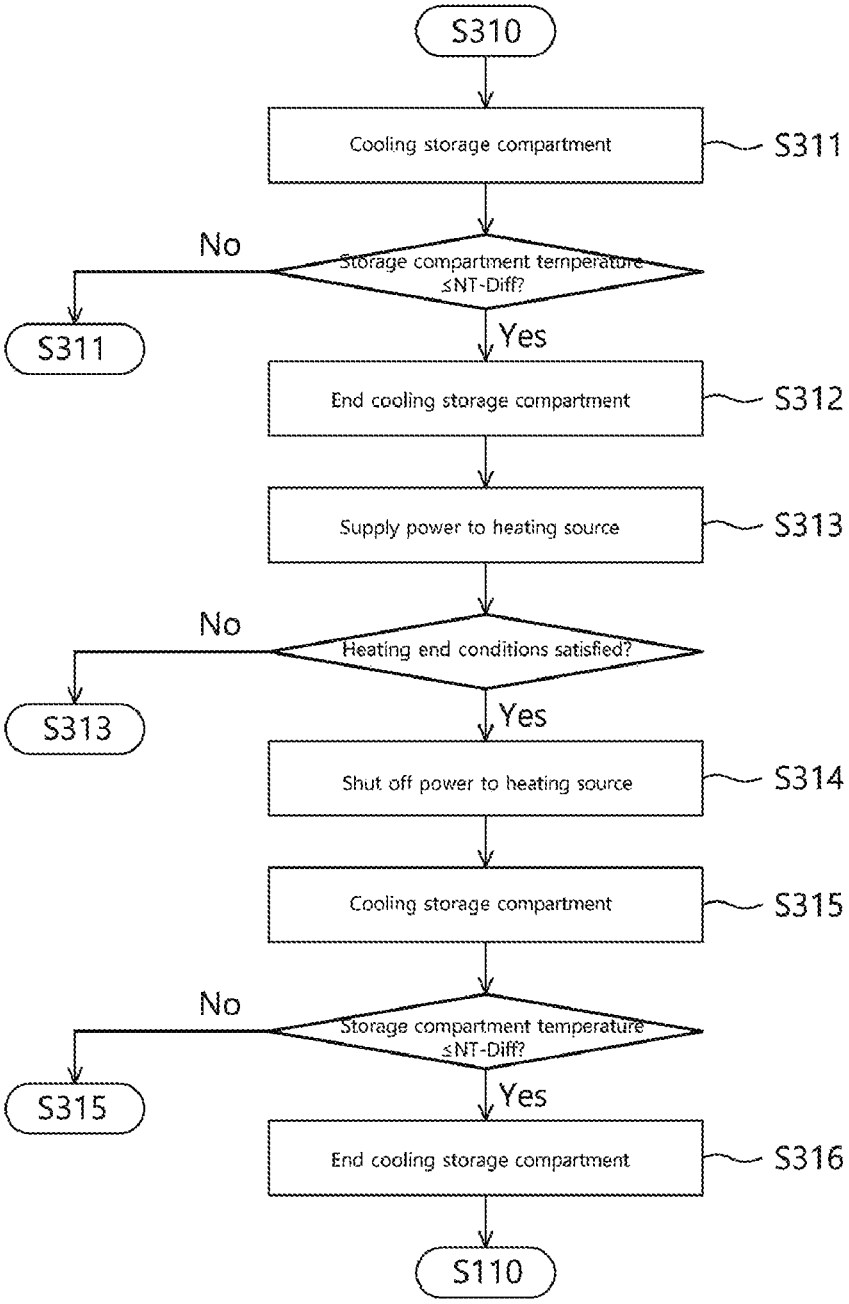

[FIG. 8]
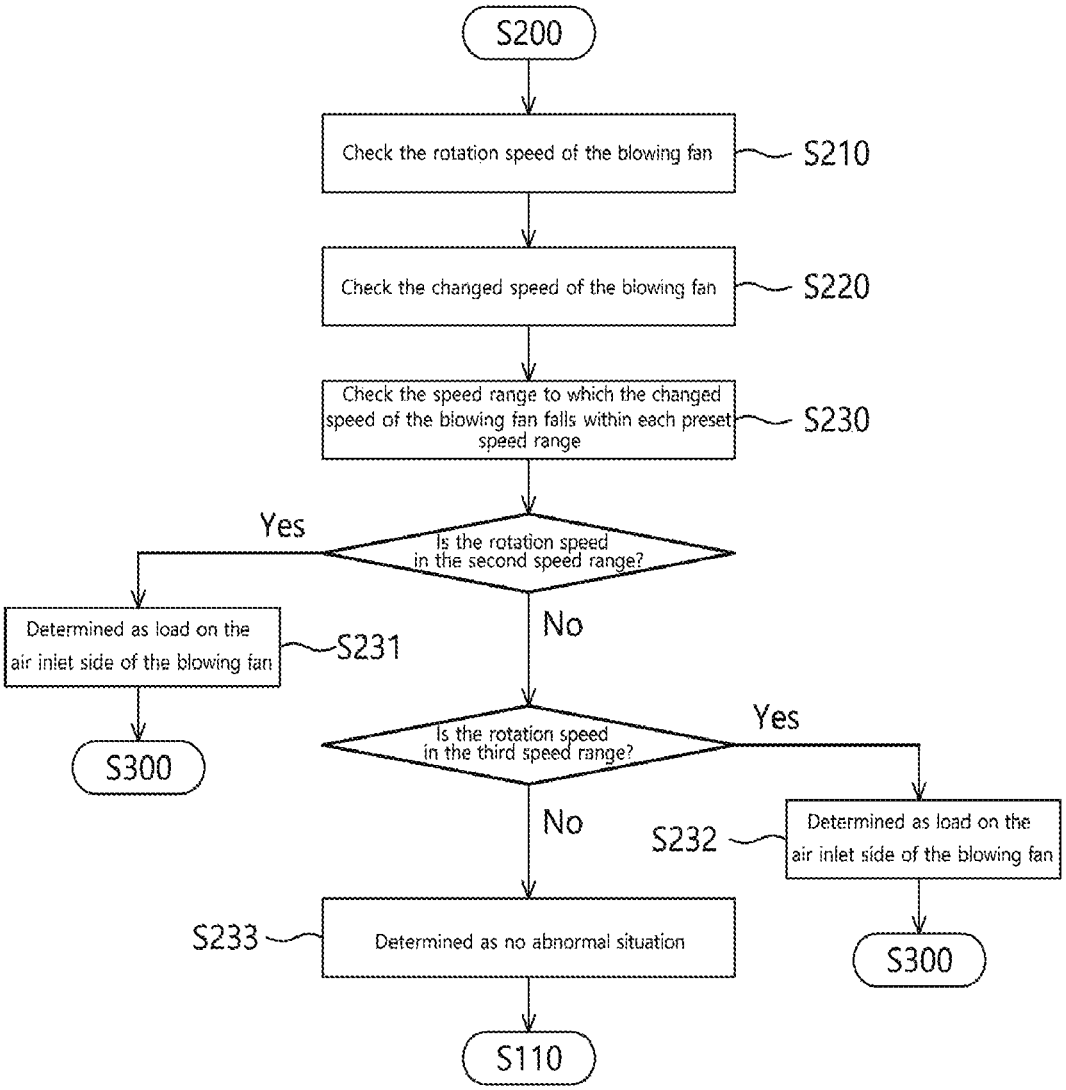

[FIG. 9]
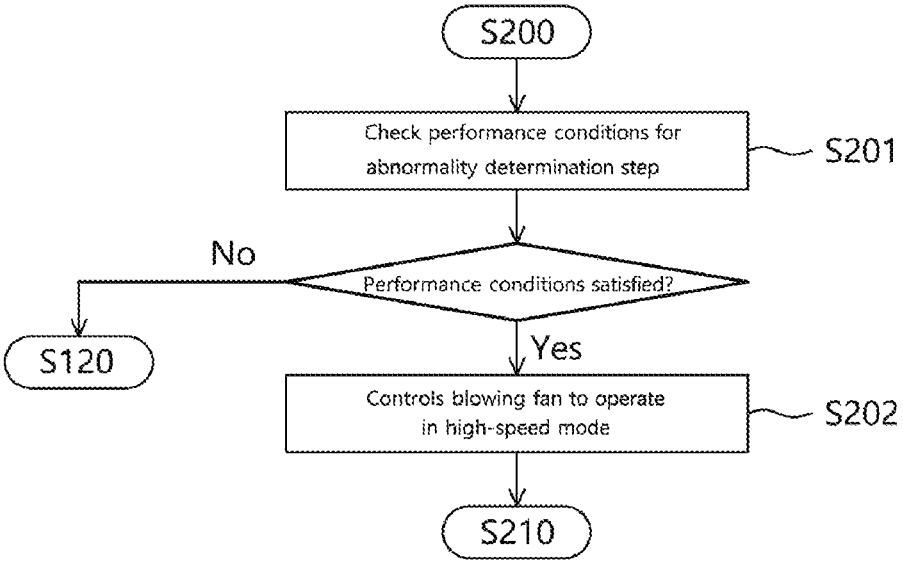
[FIG. 10]
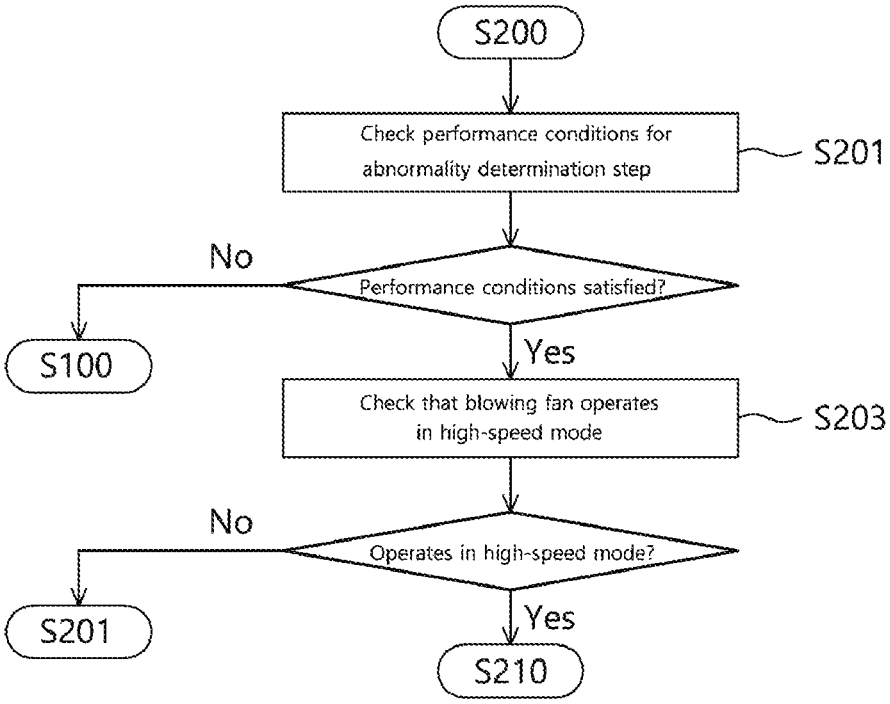

[FIG. 11]
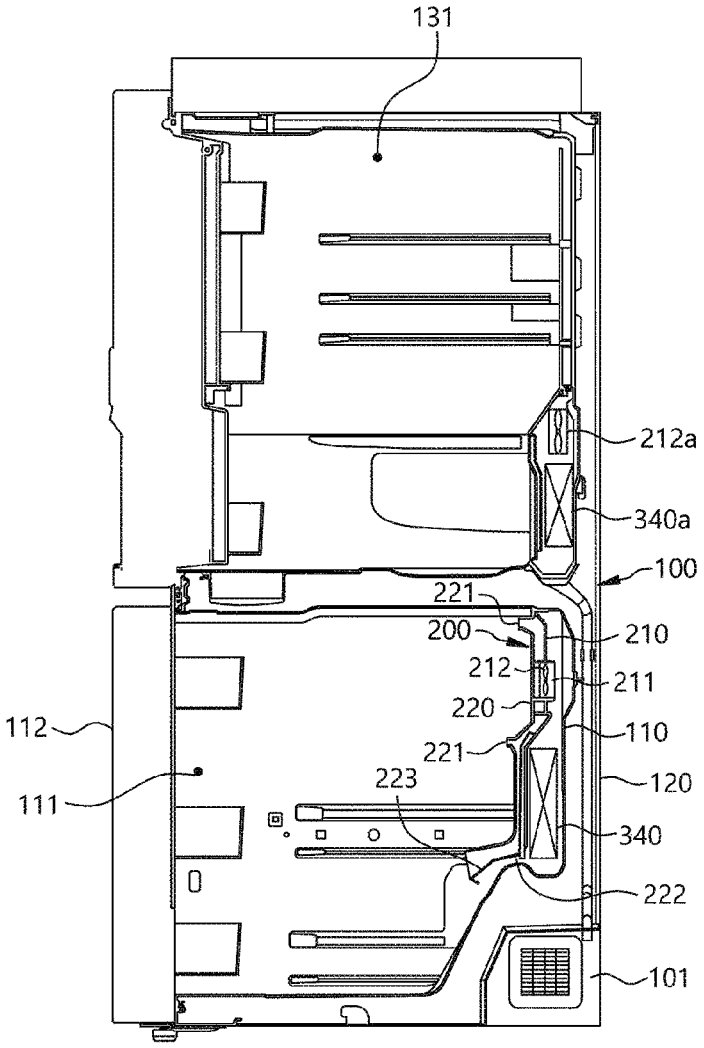

OPERATION CONTROL METHOD FOR REFRIGERATOR

CROSS REFERENCE TO RELATED APPLICATION

This application is a National Stage Application under 35 U.S.C. § 371 of International Application No. PCT/KR2022/007309, filed on May 23, 2022, which claims the benefit if earlier filing date and right of priority to Korean Patent Application No. 10-2021-0082389, filed on Jun. 24, 2021, the entire contents of which is incorporated herein for all purposes by this reference.

TECHNICAL FIELD

The present disclosure relates to an operation control method for a refrigerator by detecting the number of operating rotations of a blowing fan provided for air circulation.

BACKGROUND ART

Generally, a refrigerator is a device capable of storing a storage objects stored in a storage space by using cold air for a long time or while maintaining a constant temperature.

The refrigerator includes a refrigeration system including one or more evaporators to generate and circulate the cold air.

Here, the evaporator performs a heat exchange function between a low-temperature, low-pressure refrigerant and the refrigerator's internal air (cold air circulating in the inside the refrigerator) to maintain the internal air within a set temperature range.

While the evaporator exchanges heat with the internal air, frost occurs on its surface due to water or humidity contained in the internal air or moisture existing around the evaporator. Accordingly, in the prior art, a defrosting operation to defrost the evaporator is periodically performed.

Conventionally, the determination of whether to perform the defrosting operation and the performance of the defrosting operation are performed in various ways.

For example, there are a method of performing a defrosting operation when a predetermined time elapses after a refrigerator operation begins, a method of performing a defrosting operation based on the accumulated operation time of a compressor, and a method of providing a separate sensor to check the accurate defrosting operation time point.

In addition, conventionally, there is a method of driving a defrost heater by measuring the load on a fan motor as in Patent Publication No. 1995-0006398, and as in Patent Publication No. 1994-0018636 and Patent Publication No. 10-2010-0032529, the number of rotations of a blowing fan is measured to determine a time for defrosting, and then the defrosting is performed.

The method of determining whether to perform the defrosting operation for measuring the number of rotations or loads of the blowing fan has an advantage of being able to determine a time point of the defrosting operation without providing a separate sensor for detecting frost formation.

However, the methods of the prior art described above only determine the time of defrosting, but do not recognize the situation during defrosting or after defrosting, so that optimal control is not performed according to the situation during or after defrosting.

In addition, the methods of the prior art only consider defrosting with the measured number of rotations of the blowing fan, but fails to consider various other problems.

For example, even when a flow path through which air is drawn into the evaporator is blocked for various reasons, the conventional view is that the evaporator is frosted.

Accordingly, the method of the prior art described above is not applied to an actual refrigerator.

DISCLOSURE

Technical Problem

An objective of the present disclosure is to provide an operation control method for a refrigerator, which is capable of accurately recognizing an occurrence of an abnormal situation as well as determining a defrosting timing by using a detected rotation speed of a blowing fan.

Another objective of the present disclosure is to provide an operation control method for a refrigerator capable of detecting an installation defect of a grille assembly, and preventing cold air leakage or gap freezing caused by a defective installation.

Another objective of the present disclosure is to provide an operation control method for a refrigerator capable of determining more various abnormal situations and making accurate judgments by increasing the discrimination of each abnormal situation determined based on the rotation speed of the blowing fan.

Another objective of the present disclosure is to provide an operation control method for a refrigerator, which distinguishes between normal frost and over-frost of a cooling source, and enables prompt defrosting in the case of over frosting.

Technical Solution

In order to achieve the above abject, an operation control method for a refrigerator according to the present disclosure may include a speed change checking step of checking a change in a rotation speed of a blowing fan provided to a grille assembly.

In addition, the operation control method for the refrigerator according to the present disclosure may include a determination step of determining whether there is an abnormality in the operation based on the checked rotation speed change of the blowing fan.

In the operation control method for the refrigerator according to the present disclosure, the determination step may include a speed range checking process for confirming that the change in rotation speed is included in any one of two or more preset speed ranges.

In the operation control method for the refrigerator according to the present disclosure, the speed range checking process may be performed using a changed speed difference or a speed difference rate of the blowing fan.

In the operation control method for the refrigerator according to the present disclosure, the speed range checking process may be performed using the rotation speed of the blowing fan.

In the operation control method for the refrigerator according to the present disclosure, an abnormality determination process of determining occurrence of an abnormal situation according to a plurality of confirmed speed ranges may be included in the determination step.

In the operation control method for the refrigerator according to the present disclosure, a control process of performing a cooling operation step or a heat supply operation step according to the determination of the abnormality determination process may be included in the determination step.

In the operation control method for the refrigerator according to the present disclosure, a control for resolving an abnormal situation may be performed in the control process.

In the operation control method for the refrigerator according to the present disclosure, a plurality of speed ranges in the speed range checking process may include a first speed range serving as a reference.

In the operation control method for the refrigerator according to the present disclosure, the plurality of speed ranges in the speed range checking process may include a second speed range faster than the first speed range.

In the operation control method for the refrigerator according to the present disclosure, the plurality of speed ranges in the speed range checking process may include a third speed range slower than the first speed range.

In the operation control method for the refrigerator according to the present disclosure, the first speed range may be set as a speed range when an abnormal situation does not occur.

In the operation control method for the refrigerator according to the present disclosure, the second speed range may be set as a speed range that may be determined as a load is applied to an air inlet side of the blowing fan.

In the operation control method for the refrigerator according to the present disclosure, as the second speed range, it is possible to determine the occurrence of at least one abnormal situation among clogging of a flow path in which air is recovered from a storage compartment to a place where a cooling source is located, frost or over-frost of the cooling source, and residual ice of the cooling source.

In the operation control method for the refrigerator according to the present disclosure, the third speed range may be set as a speed range that may be determined as a load is applied to an air outlet side of the blowing fan.

In the operation control method for the refrigerator according to the present disclosure, as the third speed range, it is possible to determine the occurrence of at least one abnormal situation among clogging of an area where air is discharged into the storage compartment within the third speed range, frosting of a flow path through which air is discharged from the blowing fan to the storage compartment, and exceeding a reference amount of storage in the storage compartment.

In the operation control method for the refrigerator according to the present disclosure, when an abnormal situation occurs in the abnormality determination process, a performance cycle of the speed change checking step may be shortened from a reference cycle.

In the operation control method for the refrigerator according to the present disclosure, when an abnormal situation does not occur in the abnormality determination process, the performance cycle of the speed change checking step may be performed for each reference cycle.

In the operation control method for the refrigerator according to the present disclosure, when an abnormal situation does not occur in the abnormality determination process, the performance cycle of the speed change checking step may be delayed than the reference cycle.

In the operation control method for the refrigerator according to the present disclosure, the speed change checking step may be performed before the heat supply operation step is performed.

In the operation control method for the refrigerator according to the present disclosure, the speed change checking step may be performed during the heat supply operation step.

In the operation control method for the refrigerator according to the present disclosure, the speed change checking step may be performed after the heat supply operation step is performed.

In the operation control method for the refrigerator according to the present disclosure, the speed change checking step may be performed when the rotation speed of the blowing fan is controlled to be faster than the rotation speed of the blowing fan in the cooling operation step.

In the operation control method for the refrigerator according to the present disclosure, the speed change checking step may be performed when an output higher than the cooling operation step is provided to the blowing fan.

In the operation control method for the refrigerator according to the present disclosure, when the speed change checking step is performed, an output higher than the cooling operation step may be provided to the blowing fan.

In the operation control method for the refrigerator according to the present disclosure, when it is determined that frost of the cooling source is generated, the heat supply operation step may be controlled to be performed after the cooling operation of the storage compartment is performed.

In the operation control method for the refrigerator according to the present disclosure, when it is determined that over frost of the cooling source is generated, the heat supply operation step may be controlled to be performed after a current operation is forcibly terminated.

In the operation control method for the refrigerator according to the present disclosure, when it is determined that over frost of the cooling source is generated, an output provided to a heating source may be controlled to be higher than a reference output.

In the operation control method for the refrigerator according to the present disclosure, when it is determined that residual ice of the cooling source is generated, a heat providing time by a heating source in a next heat supply operation step may be controlled to be longer than a heat providing time by the heating source in the previous heat supply operation step.

In the operation control method for the refrigerator according to the present disclosure, in the cooling operation step, the supply of air may be controlled so that the storage compartment is maintained at a set reference temperature.

In the operation control method for the refrigerator according to the present disclosure, the heat supply operation step may include a deep cooling process in which the storage compartment is cooled to a lower limit temperature set based on the set reference temperature.

In the operation control method for the refrigerator according to the present disclosure, the heat supply operation step may include a heating process of providing heat to the cooling source.

In the operation control method for the refrigerator according to the present disclosure, the heat supply operation step may include a post-heating cooling process to cool the storage compartment to the lower limit temperature.

In the operation control method for the refrigerator according to the present disclosure, when it is determined that the frost of the cooling source occurs, both the deep cooling process and the heating process may be performed in the heat supply operation step.

In the operation control method for the refrigerator according to the present disclosure, when it is determined that over-frost of the cooling source occurs, the deep cooling process may be omitted and the heating process may be performed in the heat supply operation step.

In the operation control method for the refrigerator according to the present disclosure, when it is determined that an abnormal situation occurs, the abnormal situation may be notified to the user.

Advantageous Effect

Since the operation control method for the refrigerator according to the present disclosure uses a rotation speed of a blowing fan, it is possible to accurately recognize the occurrence of an abnormal situation on an air inlet side or air outlet side of the blowing fan without using various sensors.

In the operation control method for the refrigerator according to the present disclosure, since it is determined whether the checked rotation speed of the blowing fan corresponds to any one speed range among a plurality of preset speed ranges, the occurrence of various abnormal situations may be classified by type.

In the operation control method for the refrigerator according to the present disclosure, since the type of abnormal situation is classified for each speed range, it is possible to accurately recognize not only the frost of a cooling source, but also residual ice or over-frost, faulty assembly, and clogged flow paths, thereby to perform operation control accordingly.

In the operation control method for the refrigerator according to the present disclosure, since the frost or over-frost of the cooling source may be distinguished, rapid defrosting operation may be performed when over-frost occurs, thereby improving power consumption efficiency.

DESCRIPTION OF DRAWINGS

FIG. 1 is a perspective view showing the exterior of a refrigerator according to an embodiment of the present disclosure.

FIG. 2 is a longitudinal cross-sectional view schematically showing the configuration of the refrigerator according to an embodiment of the present disclosure FIG. 3 is a side view showing the relationship between a cooling source and a heating source of the refrigerator according to an embodiment of the present disclosure.

FIG. 4 is a schematic block diagram showing a structure related to a control unit of the refrigerator according to an embodiment of the present disclosure.

FIG. 5 is a flowchart showing a basic operation control process of the refrigerator according to an embodiment of the present disclosure.

FIG. 6 is a flowchart showing a control process during a heat supply operation of the refrigerator according to an embodiment of the present disclosure.

FIG. 7 is a flowchart showing a control process during a cooling operation of the refrigerator according to an embodiment of the present disclosure.

FIG. 8 is a flowchart showing a control process during an operation for determining an abnormality of the refrigerator according to an embodiment of the present disclosure.

FIG. 9 is a flowchart showing a control process of an example at the start of operation for determining an abnormality of a refrigerator according to an embodiment of the present disclosure.

FIG. 10 is a flowchart showing a control process of another example at the start of operation for determining an abnormality of the refrigerator according to an embodiment of the present disclosure.

FIG. 11 is a cross-sectional view showing another example of a refrigerator according to an embodiment of the present disclosure.

BEST MODE

Hereinafter, a preferred embodiment of a refrigerator and a control method thereof of the present disclosure will be described with reference to FIGS. 1 to 11.

The refrigerator of the present disclosure may check a change in the rotation speed of a blowing fan and determine whether there is an abnormality in operation based on the checked change in the rotation speed of the blowing fan.

In particular, the refrigerator of the present disclosure provides a plurality of speed ranges, and it is possible to determine various abnormal situations by checking that the rotation speed of the blowing fan belongs to any one speed range among the provided speed ranges.

Exemplary embodiments of the refrigerator according to the present disclosure will be described with reference to FIGS. 1 to 21.

FIG. 1 is a front view schematically showing an internal configuration of the refrigerator according to an embodiment of the present disclosure, and FIG. 2 is a longitudinal cross-sectional view schematically showing a configuration of the refrigerator according to an embodiment of the present disclosure.

As shown in these drawings, a casing 100 may be included in the refrigerator according to an embodiment of the present disclosure.

The casing 100 may include an inner casing 110 forming an inner wall surface of the refrigerator and an outer casing 120 forming an exterior of the refrigerator. The casing 100 may provide a storage compartment 111 in which stored objects are stored.

The storage compartment 111 may be provided with only one or more storage compartments. For example, a plurality of inner casings 110 may be provided to provide a plurality of storage compartments. Of course, although not shown, a plurality of storage compartments may be provided in one inner casing 110.

The storage compartment 111 may be maintained at a set reference temperature (NT). The set reference temperature (NT) may be set to a temperature at which stored objects are not frozen. The set reference temperature (NT) may be set to a temperature range lower than an external temperature (room temperature) of the refrigerator. The set reference temperature (NT) is a temperature at which stored objects are not frozen and may be set to a temperature range lower than the external temperature (room temperature) of the refrigerator.

When a plurality of storage compartments 111 are provided, each storage compartment may be maintained at a different set reference temperature. For example, one storage compartment may be maintained at a first set reference temperature, and the other storage compartment may be maintained at a second set reference temperature lower than the first set reference temperature.

The storage compartment 111 may be operated at an operation reference value (NT±Diff) to maintain the set reference temperature (NT).

The operation reference value (NT±Diff) is a temperature range value that includes a lower limit temperature (NT−Diff) and an upper limit temperature (NT+Diff). That is, when an internal temperature of the storage compartment 111 reaches the lower limit temperature (NT−Diff) based on the set reference temperature, an operation for supplying cold air is stopped. On the other hand, when the internal compartment temperature rises based on the set reference temperature, operation for supplying cold air may be resumed before the internal compartment temperature reaches the upper limit temperature (NT+Diff).

As such, cold air is supplied or stopped supplying to the inside of the storage compartment 110 in consideration of the operation reference value (NT±Diff) based on the set reference temperature (NT).

Meanwhile, air is circulated in the storage compartment 111 described above so that the internal temperature of the storage compartment 111 is maintained.

The inner casing 110 is formed as a box body having an open front, and the open front of the inner casing 110 may be opened and closed with a door 112. The door 112 may have a rotary opening and closing structure or a drawer-type opening and closing structure. One or more doors 112 may be provided.

Next, the refrigerator according to the embodiment of the present disclosure may include a grille assembly 200.

The grille assembly 200 is provided to guide air flow to the storage compartment 111.

The grille assembly 200 is positioned in the inner casing 110 to divide the storage compartment 111 in the inner casing 110 from an installation space where a cooling source 340 is located. The grille assembly 200 forms a rear wall surface in the storage compartment 111 provided in the inner casing 110.

The grille assembly 200 may include a shroud 210. The shroud 210 forms the rear surface of the grille assembly 200.

An air inlet 211 is formed in the shroud 210 for introducing air passing through the cooling source 340.

A blowing fan 212 may be installed in the shroud 210. The blowing fan 212 is positioned at the air inlet 211 and generates an air flow that flows into the air inlet 211 after passing through the cooling source 340.

The grille assembly 200 may include a grille panel 220 which forms a front surface (a surface exposed into the storage compartment) of the grille assembly 200.

A plurality of cold air outlets 221 communicating with the inside of the storage compartment 111 are formed in the grille panel 220.

The grille panel 220 is coupled to the front surface of the shroud 210 and provides a flow path (not shown) for air flow between the grille panel 210 and the shroud 210. That is, the air introduced through the air inlet 211 of the shroud 210 flows along the flow path between the shroud 210 and the grille panel 220 and is supplied to the storage compartment 111 through each cold air outlet 221.

An air intake 222 may be formed at a lower end of the grille panel 220 so that the air flowing in the storage compartment 111 is recovered to the air inlet side of the cooling source 340 located in the installation space.

A suction duct 223 may be formed at a lower end of the grille panel 220 to guide the air flowing in the storage compartment 111 to the air intake 222.

Next, the refrigerator according to an embodiment of the present disclosure may include a cooling source 340.

The cooling source 340 is provided to cool the air supplied to the storage compartment 111.

For example, the cooling source 340 may be composed of an evaporator forming a refrigeration cycle together with a compressor 310 and a condenser (not shown). In this case, the compressor and condenser may be located in a machine room 101.

Meanwhile, when a plurality of inner casings 110 are provided, the cooling source 340 may be provided to each inner casing or may be provided to at least one inner casing.

The cooling source 340 may be located behind the grille assembly 200 located in the inner casing 110. That is, the front space of the grille assembly 200 is provided to the storage compartment 111, and the rear space of the grille assembly 200 is provided as a space in which the cooling source 340 is installed.

The cooling source 340 may be positioned lower than the blowing fan 212 installed in the grille assembly 200. That is, air may pass through the blowing fan 212 after completely passing through the cooling source 340.

Although not shown, the cooling source 340 may be positioned at the same height as the blowing fan 212 installed in the grille assembly 200 or higher than the blowing fan 212, depending on the type or structure of a refrigerator.

Next, the refrigerator according to an embodiment of the present disclosure may include a heating source 400.

The heating source 400 is installed to provide heat to the cooling source 340.

The heating source 400 may include an electric heater (e.g., a sheath heater) that provides heat while being heated by power supply.

As shown in FIG. 3, the heating source 400 may be located below the cooling source 340, whereby the cooling source 340 may receive heat generated by the heating source 400 by power supply as radiant heat.

Although not shown, the heating source 400 directly conducts heat while being in contact with a surface of the cooling source 340, or the heating source 400 may be provided on an upper side or a circumferential side of the cooling source 340.

Next, the refrigerator according to an embodiment of the present disclosure may include a control unit 500.

As shown in FIG. 4, the control unit 500 may be configured to perform various operation controls of the refrigerator by controlling the operation of each component constituting the refrigerator.

As an example of an operation control by the control unit 500, the control unit 500 may be configured to perform the cooling operation step S100 as shown in FIGS. 5 and 6.

The cooling operation step S100 is an operation step of providing the cooling air, which has been heat-exchanged while passing through the cooling source 340 located in the rear of the grille assembly 200 to the storage compartment 111 in front of the grille assembly 200.

In this case, the cooling operation step S100 may be performed based on the set reference temperature of the corresponding storage compartment 111. That is, as shown in FIG. 6, when the temperature in the storage compartment 111 is checked S110 and the temperature is higher than the upper limit temperature (NT+Diff) of the set reference temperature (NT), the compressor 310 and the blowing fan 212 may be controlled to operate S120. When the temperature in the storage compartment 111 is lower than the lower limit temperature (NT−Diff) of the set reference temperature (NT), the operation of at least one of the compressor 310 or the blowing fan 212 may be controlled to be stopped S130.

The blowing fan 212 may be controlled to rotate in any one of a low speed, a medium speed, or a high speed mode. The medium speed mode may be a speed mode for applying power to rotate the blowing fan 212 at a speed faster than that of the low speed mode. The high speed mode may be a speed mode for applying power to rotate the blowing fan 212 at a speed faster than that of the medium speed mode.

During a normal cooling operation, the blowing fan 212 may be operated in a low or medium speed mode.

At the beginning of the normal cooling operation, the blowing fan 212 may be controlled to change its speed mode to the medium speed mode or the low speed mode after starting the operation in the high speed mode.

As another example of the operation control of the control unit 500, the control unit 500 may control to perform the heat supply operation step S310.

The heat supply operation step S310 is an operation step of providing heat to the cooling source 340 by controlling the heating source 400. That is, when frosting of the cooling source 340 occurs, the control unit 500 controls the heating source 400 to provide heat to the cooling source 340, thereby removing frost or ice formed on the cooling source 340.

In the heat supply operation step S310, relatively high temperature heat or relatively low temperature heat may be provided by the selection of the control unit 500.

For example, when it is determined that the cooling source 340 has a normal level of frost, the control unit 500 controls to provide relatively low temperature heat sufficient to solve the frost, thereby reducing power consumption.

When it is determined that the cooling source 340 is an overly frosted, the control unit 500 may control to provide relatively high temperature heat (heat higher than the heat provided during normal level of frost) to solve the over frosting. That is, in the case of over frosting, the control unit 50 may increase the output of the heating source 400 so that the frost of the cooling source 340 is quickly removed by the high-temperature heat, or control the heating time to be prolonged without increasing the output of the heating source 400.

The heat supply operation step S310 may include heating processes S313, S314 of providing heat to the cooling source 340 as shown in FIG. 7. That is, as the heating source 400 is heated by the heating process, heat may be provided to the cooling source 340.

The heating process is performed by supplying power S313 to the heating source 400.

The heating process ends by turning off the power supply S314 of the heating source 400 when heating end conditions are satisfied after the power supply of the heating source 400. In this case, the heating end conditions may include at least one of a condition in which the temperature of the cooling source 340 satisfies a set temperature, a condition in which the temperature of the air outlet side of the cooling source 340 satisfies the set temperature, and a condition in which the internal temperature of the storage compartment exceeds the set temperature.

In addition, the heat supply operation step S310 may include the deep cooling processes S311, S312 of cooling the storage compartment 111 to the lower limit temperature (NT−Diff) set based on the reference set temperature (NT) as shown in FIG. 7.

That is, before providing heat to the cooling source 340, the storage compartment 111 is cooled to the lower limit temperature (NT−Diff) by the deep cooling process. Accordingly, a rapid increase in temperature of the storage compartment 111 during the heating process may be prevented, and power consumption for cooling the storage compartment 111 after the heating process may be reduced.

In this deep cooling process, when the operating condition of the heat supply operation step S310 is satisfied, the storage compartment 111 is cooled S311. When the temperature of the storage compartment 111 reaches the lower limit temperature (NT−Diff), the cooling of the storage compartment 111 is ended S312.

In addition, the heat supply operation step may include a post-heating cooling process of cooling the storage compartment 111 to the lower limit temperature (NT−Diff) set based on the reference set temperature (NT) as shown in FIG. 7. The post-heating cooling process is to cool the storage compartment 111 as quickly as possible so that the stored objects are protected.

In the post-heating cooling process, the storage compartment 111 is cooled S315 when the power of the heating source is cut off S314, and the cooling of storage compartment 111 is ended S316 when the temperature of the storage compartment 111 reaches the lower limit temperature (NT−Diff).

The control unit 500 may control to provide heat to the cooling source 340 through operation control of components other than the heating source 400. For example, heat generated by the high-temperature refrigerant compressed by the compressor may be controlled to be provided to the cooling source 340.

As another example of the operation control of the control unit 500, the control unit 500 may control to perform an abnormality determination step S200.

The abnormality determination step S200 is the control step of checking the rotation speed of the blowing fan 212 provided to the grille assembly 200 as shown in FIG. 5, and determining the occurrence of an abnormal situation or the type of the abnormal situation by the checked rotation speed of the blowing fan 212.

The rotation speed of the blowing fan 212 may be measured using a separately provided a speedometer 212*a*. In this case, the speedometer 212*a* may include at least one of a contact type measurement sensor, a non-contact type measurement sensor such as an optical sensor, and a stroboscope type measurement sensor.

The abnormality determination step S200 may be performed during the cooling operation step S100, that is, the abnormality determination step S200 may be performed when a predetermined cycle is reached during the normal cooling operation.

Of course, the abnormality determination step S200 may be performed at least at any one of before or during the heat supply operation step S310, or after the heat supply operation step S310.

The abnormality determination step S200 before the heat supply operation step S310 may be performed to determine the start time of the heat supply operation step S310.

The abnormality determination step S200 during the heat supply operation step S310 may be performed to determine the end time of the heat supply operation step S310.

The abnormality determination step S200 after the heat supply operation step S310 may be performed to check residual ice after the heat supply operation step S310 is ended.

In the abnormality determination step S200, a rotation speed checking process may be performed.

The rotation speed checking process is a process of checking the rotation speed S210 of the blowing fan 212.

The rotation speed of the blowing fan 212 may be identified by a non-contact type sensor or by measuring the rotation speed of a fan motor with respect to the motor shaft.

In addition, in the abnormality determination step S200, a speed change checking process may be performed.

The speed change checking process is performed by checking whether the rotation speed of the blowing fan 212 checked in the rotation speed checking process is changed from a reference rotation speed S220.

That is, even though the same power is applied to the blowing fan 212, when the outputted rotation speed of the blowing fan 212 is changed from the reference rotation speed, the changed speed is checked. The changed speed becomes a specified speed value, or may be a speed change rate from the reference rotation speed.

The reference rotation speed is a rotation speed obtained when specific power is applied to the blowing fan 212 in an unloaded state where there is no load on the air inlet side or the air outlet side of the blowing fan 212. Of course, the reference rotation speed may be set as the rotation speed of the blowing fan measured in a state in which it may be determined that there is no load. For example, the reference rotation speed may be set at the initial start of the refrigerator or at the end of the defrosting operation.

In addition, in the above-described abnormality determination step, a speed range checking process may be performed.

The speed range checking process is a process of confirming S230 that a change in the rotation speed of the blowing fan 212 (the difference between the reference rotation speed and the current rotation speed, or a ratio thereof) is included in any one of a plurality of preset speed ranges.

The plurality of speed ranges may include a first speed range, a second speed range faster than the first speed range, and a third speed range slower than the first speed range.

In this case, the respective speed range may be differently set for each the high speed mode, the medium speed mode, or the low speed mode of the corresponding blowing fan.

Of course, the plurality of speed ranges may be set to only the first speed range and the second speed range having a speed faster than the first speed range, or may be set to only the first speed range and the third speed range having a speed slower than the first speed range.

Here, the first speed range may be a speed range in which it is determined that there is no load on the air inlet side or the air outlet side of the blowing fan 212. The second speed range may be a speed range that may be determined as a load is applied to the air inlet side of the blowing fan 212. The third speed range may be a speed range that may be determined as a load is applied to the air outlet side of the blowing fan 212.

Meanwhile, the speed change checking process may be performed, not by checking the changed speed difference value of the blowing fan 212, but by checking which speed range the current rotation speed of the blowing fan 212 belongs to. In this case, each speed range may be a value in a range exceeding the rotation speed of the blowing fan 212 or a value less than the rotation speed of the blowing fan 212.

In addition, in the abnormality determination step S200, an abnormality determination process may be performed.

The abnormality determination process is a process of determining the occurrence of an abnormal situation according to a specific speed range to which the rotation speed of the blowing fan 212 checked in the speed range checking process belongs.

For example, when the rotation speed of the blowing fan 212 is out of the first speed range and included in the second speed range, or when the rotation speed of the blowing fan 212 is out of the first speed range and included in the third speed range, it may be determined that an abnormal situation occurs.

In the abnormality determination process, the type of abnormal situation may be determined by using a plurality of speed ranges checked in the speed range checking process. That is, a plurality of abnormal situations or types of abnormal situations are designated according to the plurality of speed ranges. In the abnormality determination process, it is determined whether one or more specified abnormal situations or types of abnormal situations belong to one of the specified abnormal situations or details of the abnormal situation types.

As an example of determining belonging to one abnormal situation type, when the rotation speed of the blowing fan 212 changes and is included in the second speed range (speed faster than the first speed range), it may be determined that an abnormal situation (load) occurs S231 on the air inlet side of the blowing fan 212.

There are various abnormal situations that occur on the air inlet side of the blowing fan 212.

For example, it may include at least one situation, such as clogging of the flow path through which air is recovered from the storage compartment 111 to the place where the cooling source 340 is provided, frost or over-frost of the cooling source 340, or residual ice of the cooling source 340. That is, when the rotation speed of the blowing fan 212 is included in the second speed range, it may be determined that at least one or more of the above-described situations occur on the air inlet side of the blowing fan 212.

In particular, when the second speed range is divided into a plurality of detailed ranges, it is possible to distinguish and determine each abnormal situation occurring at the air inlet side of the blowing fan 212.

For example, when the speed of the blowing fan 212 belongs to a relatively low first range of the second speed ranges, it may be determined as the residual ice of the cooling source 340.

When the speed of the blowing fan 212 belongs to a second range higher than the first range among the second speed ranges, it may be determined as the frost of the cooling source 340.

When the speed of the blowing fan 212 belongs to a third range higher than the second range among the second speed ranges, it may be determined that the cooling source 340 is overly frosted or the air intake 222 is clogged.

In addition, in the case of over frost of the cooling source 340 and clogging of the air intake 222, it may be more clearly distinguished by confirming whether the speed change of the blowing fan 212 is a continuous speed change or a rapid speed change.

For example, when the speed of the blowing fan 212 is steadily changed until it reaches the third range, it may be determined as over-frost of the cooling source 340. When the speed of the blowing fan 212 is rapidly changed to reach the third range, it may be determined that an unexpected object (for example, vinyl or foreign matter in the storage compartment) instantaneously blocks the air intake 222.

As another example of determining that the blowing fan 212 belongs to one or more types of abnormal situations, when the rotation speed of the blowing fan 212 is changed and included in the third speed range (the speed is slower than the first speed range) while the blowing fan 212 is controlled to be maintained in a specific speed mode, it may be determined that an abnormal situation (load) occurs S232 on the air outlet side of the blowing fan 212.

There are various reasons why the air outlet side of the blowing fan 212 is clogged.

The above various reasons may include at least one situation, such as clogging of the cold air outlet 221, frost in any one of flow paths through which air is discharged from the blowing fan 212 to the storage compartment 111, and a storage in the storage compartment 111 exceeding a reference amount. That is, when the rotation speed of the blowing fan 212 is included in the third speed range, it may be determined that at least one or more of the above-described situations occurs on the air outlet side of the blowing fan 212.

In particular, when the third speed range is divided into a plurality of detailed ranges, each abnormal situation occurring on the air outlet side of the blowing fan 212 may be separately determined.

For example, when the speed of the blowing fan 212 belongs to a first range, which is relatively high among the third speed range, it may be determined that the flow path is frosted or residual ice is present or the blowing fan 212 is frozen. When the speed of the blowing fan 212 belongs to a second range lower than the first range, it may be determined that the cold air outlet 221 is clogged.

Here, the clogging of the cold air outlet 221 may occur by various causes. For example, a storage object located in the storage compartment 111 may block the cold air outlet 221. The clogging may occur due to the freezing of the cold air outlet 221.

Meanwhile, if the grille assembly 200 is not correctly assembled in the inner casing 110, or if the user damages the grille assembly 200 while storing storage, lifting may occur in the contact area between the grille assembly 200 and the inner casing 110.

In addition, when the above-described lifting occurs, the installation space in the inner casing 110 and the storage compartment 111 communicate with each other, so that the speed of the blowing fan 212 may reach the third speed range.

Considering this, when the speed of the blowing fan 212 is within the third speed range, it is checked whether the storage compartment 111 has poor cooling (e.g., weakly cooling), thereby determining that the grille assembly 200 is lifted when the cooling failure exists.

When an assembly failure occurs between the shroud 210 and the grille panel 220, the speed of the blowing fan 212 may deviate from the first speed range, and in this case, the faulty assembly may be determined in consideration of the cooling failure.

Meanwhile, when the abnormality determination step S200 is performed, the blowing fan 212 may be controlled to operate in the high speed mode.

For example, while the blowing fan 212 is rotating in the low speed mode or the medium speed mode as shown in FIG. 9, a performance condition S201 for performing the abnormality determination step is determined. When the performance condition S201 is satisfied, the blowing fan 212 is controlled to rotate in the high speed mode S202, and then the abnormality determination step S200 is performed.

In this case, the high speed mode is a speed mode in which the blowing fan 212 is controlled to rotate faster than a speed mode (low speed mode or medium speed mode) in which the blowing fan 212 rotates during the normal cooling operation. Switching to the high speed mode may be performed by increasing the output provided to the blowing fan 212.

That is, performing the abnormality determination step while the blowing fan 212 is rotating at high speed is preferable because it is possible to obtain a discriminating rotation speed change value having characteristics for each abnormal situation.

Of course, the abnormality determination step S200 may be controlled to be performed when the blowing fan 212 rotates in the high speed mode.

For example, as shown in FIG. 10, the performance condition S201 for performing the abnormality determination step S200 is determined while the normal cooling operation S100 or other operations are being performed. When the performance condition S201 is satisfied and it is checked whether the blowing fan 212 rotates in the high speed mode S203, the abnormality determination step S200 is controlled to be performed.

As another example, when the blowing fan 212 rotates in the high speed mode at least at any one of before, during, or after the performance of the heat supply operation step S310, the abnormality determination step S200 may be controlled to be performed regardless of the performance condition S201 of the abnormality determination step S200.

As another example, when the blowing fan 212 is rotated in a higher speed mode faster than the cooling operation step S100 in order to rapidly cool the storage compartment 111 after the heat supply operation step S310 is performed, the abnormality determination step S200 may be controlled to be performed.

In addition, when it is determined that an abnormal situation has occurred in the abnormality determination step S200 previously performed, the abnormality determination step S200 may be performed shorter than a reference cycle. Of course, when an abnormal situation is determined in the current abnormality determination step S200, a performance cycle of the next abnormality determination step S200 may be controlled to be shorter than the reference cycle.

On the other hand, when it is determined that an abnormal situation does not occur in the abnormality determination step S200, the performance cycle of the next abnormality determination step S200 may be performed at the predetermined reference cycle or may be controlled to be performed later than the reference cycle.

By shortening or delaying the abnormality determination step S200 rather than the reference cycle, power consumption may be reduced and the occurrence of an abnormal situation may be quickly identified.

As another example of operation control by the control unit 500, the control unit 500 may perform an abnormality resolving step S300.

In the abnormality resolving step S300, a corresponding operation may be performed according to the identified abnormal situation or the type of abnormal situation according to the determination of the abnormality determination step S200.

That is, in the abnormality resolving step S300, at least one of the cooling operation step, the heat supply operation step S310, or control for resolving the abnormal situation may be performed according to the identified abnormal situation or the type thereof.

Here, the control for resolving the abnormal situation may include a control for notifying the user of the abnormal situation.

For example, it is possible to notify the refrigerator's display device (not shown) of an abnormal situation through an error code or phrase, or to notify a user's set terminal (not shown) of an abnormal situation through an error code or phrase.

In this case, the user may be an actual user of the refrigerator, may be any one selected user, or may be a manager for repair or the like or an online manager.

The control for resolving the abnormal situation may include control for performing the cooling operation step S100 and the heat supply operation step S310.

As an example, when an abnormal situation identified by the abnormality determination step S200 is determined to be the frost of the cooling source 340, the abnormality resolving step S300 may control to perform the heat supply operation step S310 after performing the cooling operation of the storage compartment 111. That is, the deep cooling process and the heating process in the heat supply operation step S310 may be sequentially performed.

By this control, since the storage compartment is sufficiently cooled before the heating process, a sudden temperature increase of the storage compartment 111 during the heating process is prevented. After the heating process, the storage compartment 111 may be cooled as quickly as possible, thereby reducing power consumption.

For another example, when an abnormal situation identified by the abnormality determination step S200 is determined to be the over-frost of the cooling source 340, the heat supply operation step S310 may be performed after the forced end of the currently performed operation in the abnormality resolving step S300. That is, the deep cooling process of the heat supply operation step S310 is skipped and the heating process is immediately performed.

By this control, it is possible to quickly resolve the over-frost of the cooling source 340.

As another example, when an abnormal situation identified by the abnormality determination step S200 is determined to be the over-frost of the cooling source 340, the output provided to the heating source 400 may be controlled to be higher than the output provided during the normal frosting of the cooling source 340.

By this control, over-frost of the cooling source 340 may be quickly resolved.

As another example, when an abnormal situation identified by the abnormality determination step S200 is determined to be residual ice of the cooling source 340, in the abnormality resolving step S300, the heat supply time to the cooling source 340 in the next heat supply operation step S310 may be controlled to be longer than the heat supply time to the cooling source 340 in the previous heat supply operation step S310.

By this control, residual ice in the cooling source 340 may be prevented by performing the next heat supply operation step S310.

Hereinafter, an example of an operation control process of the refrigerator according to the above-described embodiment will be briefly described.

First, the control unit 500 performs the cooling operation according to the temperature in the storage compartment 111 or stops the cooling operation.

That is, when the temperature in the storage compartment 111 exceeds the upper limit temperature (NT+Diff), the compressor and the blowing fan 212 are controlled to supply cold air in the storage compartment 111.

In this case, the blowing fan 212 may be controlled to rotate in any one speed mode of low speed, medium speed, or high speed mode. The medium speed mode is a speed mode in which power is applied so that the blowing fan 212 rotates at a faster speed than the low speed mode. The high speed mode is a speed mode in which power is applied so that the blowing fan 212 rotates at a faster speed than the medium speed mode.

During the normal cooling operation, the blowing fan 212 may be operated in the low speed mode.

When the blowing fan 212 is operated, air sequentially passes through the cooling source 340 and the blowing fan 212, passes through each cold air outlet 221 formed in the grille panel 220, and flows into the storage compartment 111. Accordingly, the storage compartment 111 may be cooled.

The air, which cools the storage compartment 111, passes through the air intake 222 of the grille assembly 200 and flows into the air inlet side of the cooling source 340 located in the inner casing 110, and then repeats the cycle of heat exchange while passing through the cooling source 340.

If the temperature in the storage compartment 111 is lower than the lower limit temperature (NT−Diff) of the set reference temperature (NT) during the normal cooling operation, the control unit stops the operation of the compressor (not shown) and the blowing fan 212. As a result, the supply of cold air to the storage compartment 111 is stopped.

During the above-mentioned cooling operation, the abnormality determination is performed to check the occurrence of an abnormal situation periodically or according to a predetermined condition.

That is, after checking the rotation speed of the blowing fan 212, the control unit 500 determines the abnormal situation or the type of the abnormal situation based on the checked rotation speed of the blowing fan 212. In this case, the blowing fan 212 is operated in the high speed mode to increase the discrimination of the speed change value.

In addition, the control unit 500 determines an abnormal situation by confirming that the rotation speed of the blowing fan 212 belongs to one of the first speed range, the second speed range, or the third speed range.

For example, when the checked rotation speed of the blowing fan 212 belongs to the second speed range, it is determined that at least one abnormal situation occurs. In this case, the abnormal situation may include at least one of clogging of the flow path through which air is recovered from the storage compartment 111 to the place where the cooling source 340 is located, frost or over-frost of the cooling source 340, residual ice of the cooling source 340, and a faulty assembly of a shroud 210 or a grille panel 220 forming the grille assembly 200.

Along with this, the type of abnormal situation is determined by confirming that each speed range corresponds to each speed divided into a plurality of detailed ranges.

For example, when the speed of the blowing fan 212 belongs to the first range of the second speed range, it is determined as residual ice of the cooling source 340. When the speed of the blowing fan 212 belongs to the second range higher than the first range among the second speed ranges, it is determined as the frost of the cooling source 340. When the speed of the blowing fan 212 belongs to the third range higher than the second range among the second speed ranges, it is determined that the cooling source 340 is over frosted or the air intake 222 is clogged.

When the speed of the blowing fan 212 belongs to the first range among the third speed ranges, it is determined that there is frost or residual ice in the flow path or that the blowing fan 212 is frozen. When the speed of the blowing fan 212 belongs to the second range lower than the first range among the third speed ranges, it is determined that the cold air outlet 221 is clogged.

Thereafter, the control unit 500 performs the cooling operation step, the heat supply operation step, or the control for resolving the abnormal situation based on the type of abnormal situation determined as described above.

For example, when the abnormal situation is determined to be a faulty assembly or a gap in the grille assembly 200, the corresponding information is transmitted to the user or a predetermined contact number or displayed on a display window of the refrigerator.

For example, when the abnormal situation is determined to be the frost or over-frost of the cooling source 340, the heating source 400 is controlled to perform the heat supply operation.

Of course, the output or heating time of the heating source 400 may be controlled differently depending on the frost or over-frost of the cooling source 340.

For example, when the abnormal situation is determined to be the residual ice of the cooling source 340, the operation time for the next heat supply is controlled to be increased.

For example, when the abnormal situation is determined to be a clogging of the air intake 222 or the cold air outlet 221, the corresponding information is transmitted to the user or a predetermined contact number, or displayed on the display window of the refrigerator.

Meanwhile, in the refrigerator of the present disclosure, two or more storage compartments 111, 131 may be provided as shown in FIG. 11. Each of the storage compartments 111, 131 may be cooled by a single cooling source 340, or each of the storage compartments 111, 131 may be cooled by a respective cooling source 340, 340*a*.

Even in the case of the above refrigerator, operation control may be performed by the operation control method of the present disclosure. For example, while the cooling operation for at least one of the storage compartments 111 and 131 is being performed or while the blowing fans 211 and 211*a* of each storage compartment 111 and 131 are rotating, the abnormality determination step S200 may be performed. The operation for resolving the abnormal situation may be performed according to the abnormal situation or the type of the abnormal situation.

The operation control method of the refrigerator of the present disclosure uses the rotation speed of the blowing fan 212, so it is possible to accurately recognize the occurrence of abnormal situations on the air inlet side or air outlet side of the blowing fan 212 without using various sensors.

In addition, since the operation control method of the refrigerator of the present disclosure determines whether the rotation speed of the blowing fan 212 checked through measurement belongs to any one of a plurality of preset speed ranges, various abnormal situations may be classified by type.

In addition, since the operation control method of the refrigerator of the present disclosure distinguishes the type of abnormal situation by a plurality of speed ranges or by detailed ranges, it is possible to accurately recognize not only the frost of the cooling source, but also whether there is residual ice or over-frost, faulty assembly, and clogged flow paths, and thereby to perform operation control accordingly.

In addition, in the operation control method of the refrigerator of the present disclosure, frost or over-frost of the cooling source 340 may be separately classified, so that rapid defrosting may be performed when over-frost occurs, thereby improving consumption efficiency.

The invention claimed is:

1. An operation control method of a refrigerator comprising:

a cooling operation step of providing heat-exchanged cooling air to a storage compartment in front of a grille assembly by passing through a cooling source located in the rear of the grille assembly;

a heat supply operation step of providing heat to the cooling source;

an abnormality determination step of checking a rotation speed of a blowing fan located in the grille assembly and determining an occurrence of an abnormal situation or a type of an abnormal situation based on the checked rotation speed of the blowing fan; and an abnormality resolving step of performing at least one step or control among the cooling operation step, the heat supply operation step, or a control for solving the occurrence of the abnormal situation or the type of the abnormal situation identified by the determination of the abnormality determination step, wherein in the abnormality determination step, at least one of the following processes is performed:

a rotation speed checking process of checking the rotation speed of the blowing fan;

a speed change checking process of checking whether the rotation speed changes from a reference rotation speed and, checking the changed speed if there is a change in the rotation speed;

a speed range checking process of checking a speed range to which the identified changed speed belongs among two or more plurality of speed ranges including a first speed range; and an abnormality determination process of determining whether a load occurs on an air inlet side of the blowing fan or a load occurs on an air outlet side of the blowing fan according to the speed range to which the changed speed belongs.

2. The method of claim 1, wherein the plurality of speed ranges include a second speed range faster than the first speed range.

3. The method of claim 2, wherein the second speed range is set as a speed range that is determined as a load occurs on an air inlet side of the blowing fan.

4. The method of claim 3, wherein when the rotation speed of the blowing fan belongs to the second speed range, in the abnormal determination process, it is determined that at least one of the following types of the abnormal situations occurs: clogging of a flow path in which air is recovered from a storage compartment to a place where the cooling source is located; frost or over-frost of the cooling source; residual ice of the cooling source; and faulty assembly of a shroud or grille panel constituting the grille assembly.

5. The method of claim 1, wherein the plurality of speed ranges include a third speed range slower than the first speed range.

6. The method of claim 5, wherein the third speed range is set as a speed range that is determined as a load occurs at an air outlet side of the blowing fan.

7. The method of claim 6, wherein when the rotation speed of the blowing fan belongs to the third speed range, in the abnormal determination process, it is determined that at least one of the following types of the abnormal situations occurs: clogging of an area where air is discharged into the storage compartment; frost in any one flow path through which air is discharged from the blowing fan to the storage compartment; exceeding a reference amount of storage in the storage compartment; and faulty assembly of the grille assembly to the inner casing.

8. The method of claim 1, wherein the plurality of speed ranges include a second speed range faster than the first speed range and a third speed range slower than the first speed range.

9. The method of claim 1, wherein the first speed range is set as a speed range that is determined that there is no load on an air inlet side or an air outlet side of the blowing fan.

10. The method of claim 1, wherein when it is determined that an abnormal situation occurs in the abnormality determination step, a performance cycle of the next abnormality determination step is controlled to be shorter than a reference cycle.

11. The method of claim 1, wherein when it is determined that no abnormal situation occurs in the abnormality determination step, the performance cycle of the next abnormality determination step is controlled to be performed for each predetermined reference cycle, or delayed than the reference cycle.

12. The method of claim 1, wherein the abnormality determination step is performed at least at any one of before or during performing the heat supply operation step, or after performing the heat supply operation step.

13. The method of claim 1, wherein the abnormality determination step is performed while the blowing fan is controlled to rotate at a speed faster than the rotation speed of the blowing fan in the cooling operation step for rapidly cooling the storage compartment after the heat supply operation is performed.

14. The method of claim 1, wherein the abnormality determination step is performed by applying a higher output than the output provided to the blowing fan during the cooling operation step.

15. The method of claim 1, wherein when the type of the abnormal situation identified by the abnormality determination step is determined to be frost of the cooling source, the abnormality resolving step is controlled to perform the heat supply operation step after performing the cooling operation of the storage compartment.

16. The method of claim 1, wherein when the type of the abnormal situation identified by the abnormality determination step is determined to be over-frost of the cooling source, the abnormality resolving step is controlled to perform the heat supply operation step after a current operation is forcibly terminated.

17. The method of claim 1, wherein when the type of the abnormal situation identified by the abnormality determination step is determined to be over-frost of the cooling source, the abnormality resolving step is controlled to perform an output provided to a heating source to be higher than a reference output.

18. The method of claim 1, wherein when the type of the abnormal situation identified by the abnormality determination step is determined to be residual ice of the cooling source, in the abnormality resolving step, a heat supply time to the cooling source in the next heat supply operation step is controlled to be longer than the heat supply time to the cooling source in the previous heat supply operation step.

19. The method of claim 1, wherein the cooling operation step is controlled to control the supply of air so that the storage compartment is maintained at a set reference temperature, and the heat supply operation step is performed by including at least one of the following processes:

a deep cooling process of cooling the storage compartment to a lower limit temperature set based on a set reference temperature;

a heating process of providing heat to the cooling source;

a post-heating cooling process of cooling the storage compartment to the lower limit temperature set based on the set reference temperature.

20. The method of claim 19, wherein when the type of the abnormal situation identified by the abnormality determination step is determined to be frost of the cooling source, both the deep cooling process and the heating process of the heat supply operation step are performed in the abnormality resolving step.

21. The method of claim 19, wherein when the type of the abnormal situation identified by the abnormality determination step is determined to be over-frost of the cooling source, the deep cooling process of the heat supply operation step is omitted and the heating process is performed in the abnormality resolving step.

22. An operation control method of a refrigerator comprising:

a cooling operation step of providing heat-exchanged cooling air to a storage compartment in front of a grille assembly by passing through a cooling source located in the rear of the grille assembly;

a heat supply operation step of providing heat to the cooling source;

an abnormality determination step of checking a rotation speed of a blowing fan located in the grille assembly and determining an occurrence of an abnormal situation or a type of an abnormal situation based on the checked rotation speed of the blowing fan; and an abnormality resolving step of performing at least one step or control among the cooling operation step, the heat supply operation step, or a control for solving the occurrence of the abnormal situation or the type of the abnormal situation identified by the determination of the abnormality determination step, wherein in the abnormality determination step, at least one of the following processes is performed:

a rotation speed checking process of checking the rotation speed of the blowing fan;

a speed change checking process of checking whether the rotation speed changes from a reference rotation speed and, checking the changed speed if there is a change in the rotation speed;

a speed range checking process of checking a speed range to which the identified changed speed belongs among two or more plurality of speed ranges including a first speed range; and an abnormality determination process of determining the occurrence of the abnormal situation or the type of abnormal situation based on the details of the occurrence of the abnormal situation or the type of the abnormal situation, which are designated according to the identified speed range.

* * * * *